US011027965B2

(12) United States Patent
Chen et al.

(10) Patent No.: US 11,027,965 B2
(45) Date of Patent: Jun. 8, 2021

(54) CAP ROTATION DEVICE

(71) Applicants: Marketech International Corp., Taipei (TW); Hsao-Szu Chang, Miaoli County (TW)

(72) Inventors: Ping-Hsu Chen, Taichung (TW); Chien-Kuo Lu, Hsinchu (TW); Chi-Yuan Pung, Hsinchu (TW); Chi-Ta Yeh, Hsinchu County (TW); Hsao-Szu Chang, Miaoli County (TW)

(73) Assignees: Marketech International Corp., Taipei (TW); Hsao-Szu Chang, Miaoli County (TW)

( * ) Notice: Subject to any disclaimer, the term of this patent is extended or adjusted under 35 U.S.C. 154(b) by 47 days.

(21) Appl. No.: 16/669,537

(22) Filed: Oct. 31, 2019

(65) Prior Publication Data

US 2020/0377358 A1 Dec. 3, 2020

(30) Foreign Application Priority Data

Jun. 3, 2019 (TW) ..... 108207048

(51) Int. Cl.
*B67D 7/02* (2010.01)
*B67D 7/78* (2010.01)

(52) U.S. Cl.
CPC ..... *B67D 7/0288* (2013.01); *B67D 7/78* (2013.01)

(58) Field of Classification Search
CPC ..... B67D 7/00; B67D 7/005; B67D 7/007; B67D 7/02; B67D 7/0227; B67D 7/0288; B67D 7/78
See application file for complete search history.

(56) References Cited

U.S. PATENT DOCUMENTS 3,765,142 A * 10/1973 Lindquist ..... B67C 3/30 53/407
4,297,827 A * 11/1981 Allison ..... G21F 9/36 53/282
4,386,637 A * 6/1983 Buchanan ..... B08B 9/0933 134/166 R
4,494,583 A * 1/1985 Reeves, Jr. ..... B65B 3/28 141/168
4,520,853 A * 6/1985 Niese ..... B67C 3/34 141/168
4,804,024 A * 2/1989 Arnemann ..... B65B 7/168 141/163
4,821,783 A * 4/1989 Arnemann ..... B67C 3/30 141/165
5,108,015 A * 4/1992 Rauworth ..... B67D 7/0294 222/400.7
5,305,581 A * 4/1994 Reeves, Jr. ..... B65B 7/2842 53/281

(Continued)

*Primary Examiner* — Timothy L Maust
(74) *Attorney, Agent, or Firm* — CKC & Partners Co., LLC

(57) ABSTRACT

A cap rotation device includes a cap rotator, a liquid transferring device and an optical detecting device. The liquid transferring device is disposed near the cap rotator, and the optical detecting device is disposed between the cap rotator and the liquid transferring device. The optical detecting device is used to detect a position of a sealing cap of a chemical drum to guide the cap rotator aligning with the sealing cap. Therefore, the sealing cap is opened by the cap rotator, and then the chemical liquid is transferred by the liquid transferring device.

9 Claims, 4 Drawing Sheets

(56) References Cited

U.S. PATENT DOCUMENTS

| | | | | |
|---|---|---|---|---|
| 5,857,308 | A * | 1/1999 | Dismore | G21F 5/12 220/323 |
| 6,085,940 | A * | 7/2000 | Ferri, Jr. | B67D 7/3263 222/152 |
| 6,523,861 | B1 * | 2/2003 | Clancy | F16L 37/23 285/316 |
| 7,819,381 | B2 * | 10/2010 | Abe | B67D 7/0294 251/144 |
| 2009/0149689 | A1 * | 6/2009 | Crawford | G21F 9/16 588/3 |

* cited by examiner

CAP ROTATION DEVICE

RELATED APPLICATIONS

This application claims priority to Taiwan Application Serial Number 108207048, filed Jun. 3, 2019, which is herein incorporated by reference.

TECHNICAL FIELD

The present disclosure generally relates to a cap rotation device. More particularly, the present disclosure relates to a multifunction cap rotation device.

BACKGROUND

With the booming of the domestic and international semiconductor markets in recent years, due to the demand for computers and the peripheral products thereof, the semiconductor industry has continued to expand, and created a large amount of foreign exchange earnings.

The manufacturing processes of semiconductor components are very complicated, and the technologies involved cover almost all of the most important and critical technologies and inventions of modern scientific research. Therefore, the semiconductor industry is not only a cutting-edge technology industry, but also requires a lot of money to maintain high-end research.

Due to the increasingly complicated design of semiconductor components, the manufacturing technologies of semiconductor components are becoming more sophisticated and complex, and the potential occupational hazards and property losses are becoming more serious in semiconductor processes. Chemicals are commonly used in processes such as epitaxy, diffusion, ions implantation, chemical vapor deposition, etching and lithography. The storage and usage in the semiconductor fabrication plant is much less than the storage and usage in a chemical or petrochemical plant. However, since the chemicals are flammable, toxic and corrosive, the chemical substances may cause personal injury and serious property damage if leakage or abnormal operation occurs.

In a semiconductor fabrication plant, chemical liquids are stored in chemical storage drums to connect to a supply line in the semiconductor fabrication plant. When the chemical liquid is used up, the chemical storage drum need to be replaced.

How to easily replace the chemical storage drum may improve the safety of the semiconductor fabrication plant, and further improve the yield thereof.

SUMMARY

One objective of the embodiments of the present invention is to provide a cap rotation device able to easily open and close sealing caps of the chemical drum, thereby improving the safety and convenience of replacing the chemical drum.

To achieve these and other advantages and in accordance with the objective of the embodiments of the present invention, as the embodiment broadly describes herein, the embodiments of the present invention provides a cap rotation device including a cap rotator, a liquid transferring device, and an optical detecting device. The liquid transferring device is disposed near the cap rotator and the optical detecting device is disposed between the cap rotator and the liquid transferring device. The optical detecting device detects a position of a sealing cap of a chemical drum to guide the cap rotator aligning with the sealing cap, the cap rotator opens the sealing cap and the liquid transferring device transfers a chemical liquid.

In some embodiments, the liquid transferring device includes a liquid extractor to extract the chemical liquid from the chemical drum.

In some embodiments, the liquid transferring device includes a liquid reflux device to flow the chemical liquid back to the chemical drum.

In some embodiments, the cap rotation device further includes a fixing plate, two vertical moving devices, and two horizontal moving devices. The vertical moving devices are respectively connected between the fixing plate and the cap rotator, and the fixing plate and the liquid transferring device vertically moves the cap rotator and the liquid transferring device respectively. The horizontal moving devices are connected to the fixing plate to horizontally move the fixing plate.

In some embodiments, the cap rotation device further includes an isolating plate and two elastic isolating shields connected to the isolating plate and the fixing plate to isolate an evaporated chemical gas of the chemical drum.

In some embodiments, the cap rotation device further includes a first motor driving the liquid transferring device to couple the liquid transferring device to an opening of the chemical drum.

In some embodiments, the cap rotation device further includes a second motor driving the cap rotator to open or close the sealing cap from the opening of the chemical drum with the cap rotator.

In some embodiments, the first motor and the second motor include torque motors.

In some embodiments, the cap rotation device further includes a liquid transferring pipe connected to the liquid transferring device to directly transfer the chemical liquid through the opening of the chemical drum.

In some embodiments, each of the vertical moving devices includes an air cylinder and a position detecting device to detect a working position of the air cylinder, and the cap rotator and the liquid transferring device adopt corresponding cap opening connectors to engage with the sealing caps respectively according to types of the sealing caps of the chemical drum.

Hence, the cap rotation device can utilize the optical detecting device to precisely align with the chemical drum, the cap rotator to open or close the sealing cap from the chemical drum, and the liquid transferring device to connect the opening of the chemical drum after the sealing cap is opened from the opening of the chemical drum. The cap rotation device can further utilize the liquid transferring pipe to directly extract the chemical liquid from the chemical drum so that the connections of the cap rotation device can be effectively reduced, and therefore the contamination and the leakage of the chemical liquid can be effectively reduced. In addition, the cap rotation device can utilize the torque motor and the position detecting device to ensure the safety and accuracy while opening or closing the sealing cap.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE PREFERRED EMBODIMENT

The following description is of the best presently contemplated mode of carrying out the present disclosure. This description is not to be taken in a limiting sense but is made merely for the purpose of describing the general principles of the invention. The scope of the invention should be determined by referencing the appended claims.

Figure 1:
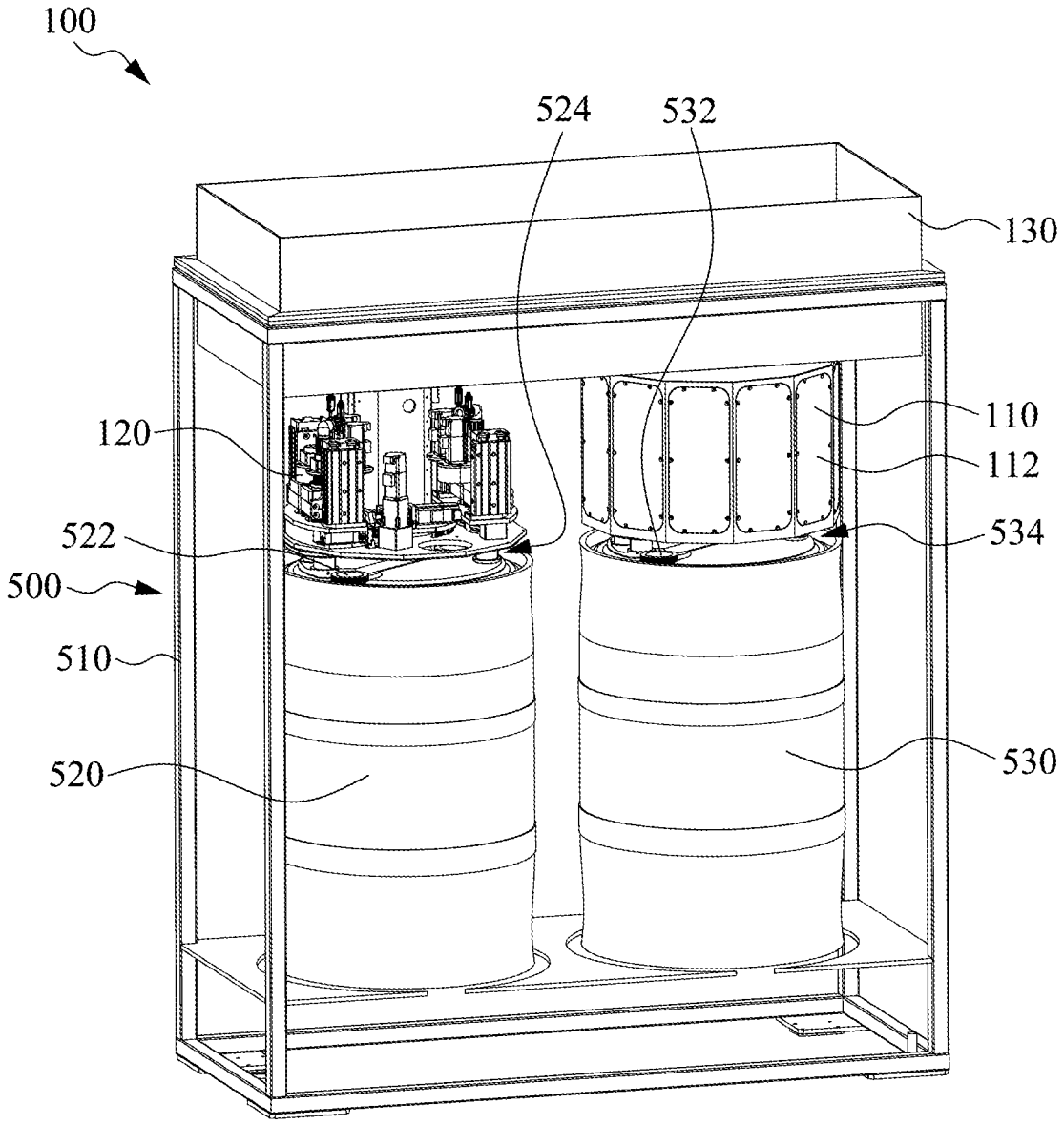
FIG. 1 illustrates a schematic perspective diagram showing a cap rotation device equipped on a multifunction cap replacement module according to one embodiment of the present invention.
Figure 2:
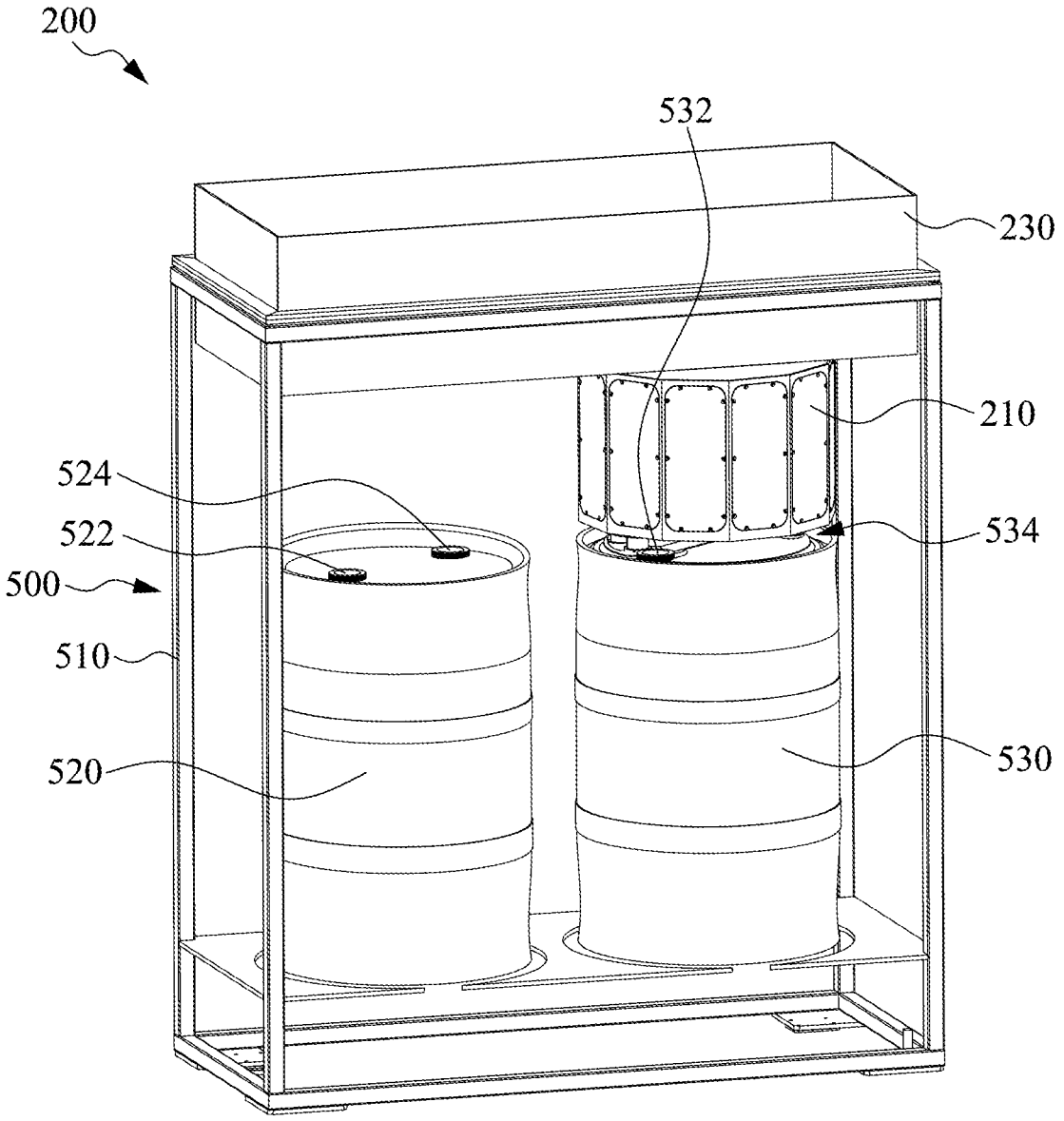
FIG. 2 illustrates a schematic perspective diagram showing a cap rotation device equipped on a multifunction cap replacement module according to another embodiment of the present invention.
Figure 3:
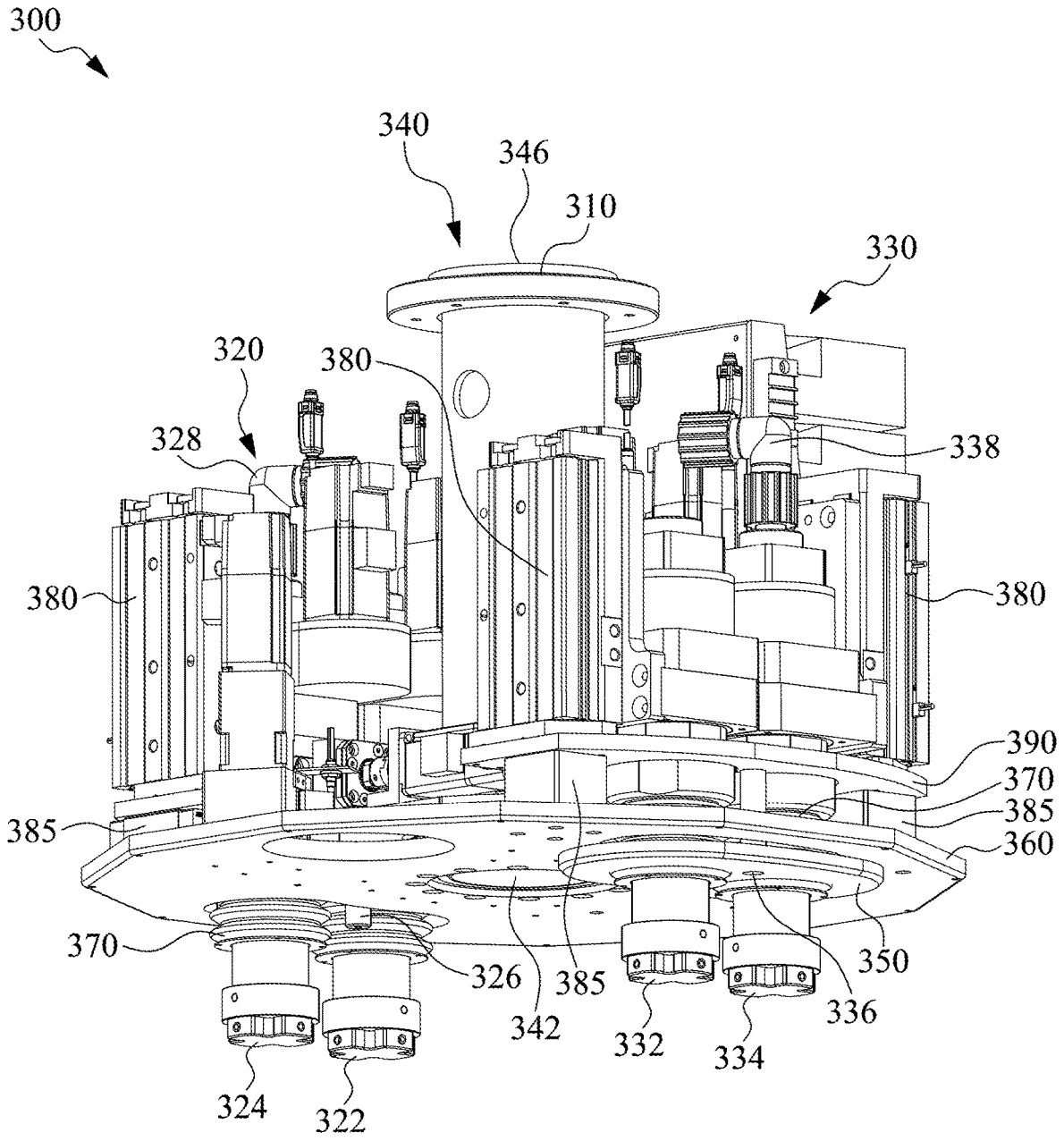
FIG. 3 illustrates a schematic perspective diagram showing a cap rotation device equipped on a cap rotation module according to embodiments of the present invention.
Figure 4:
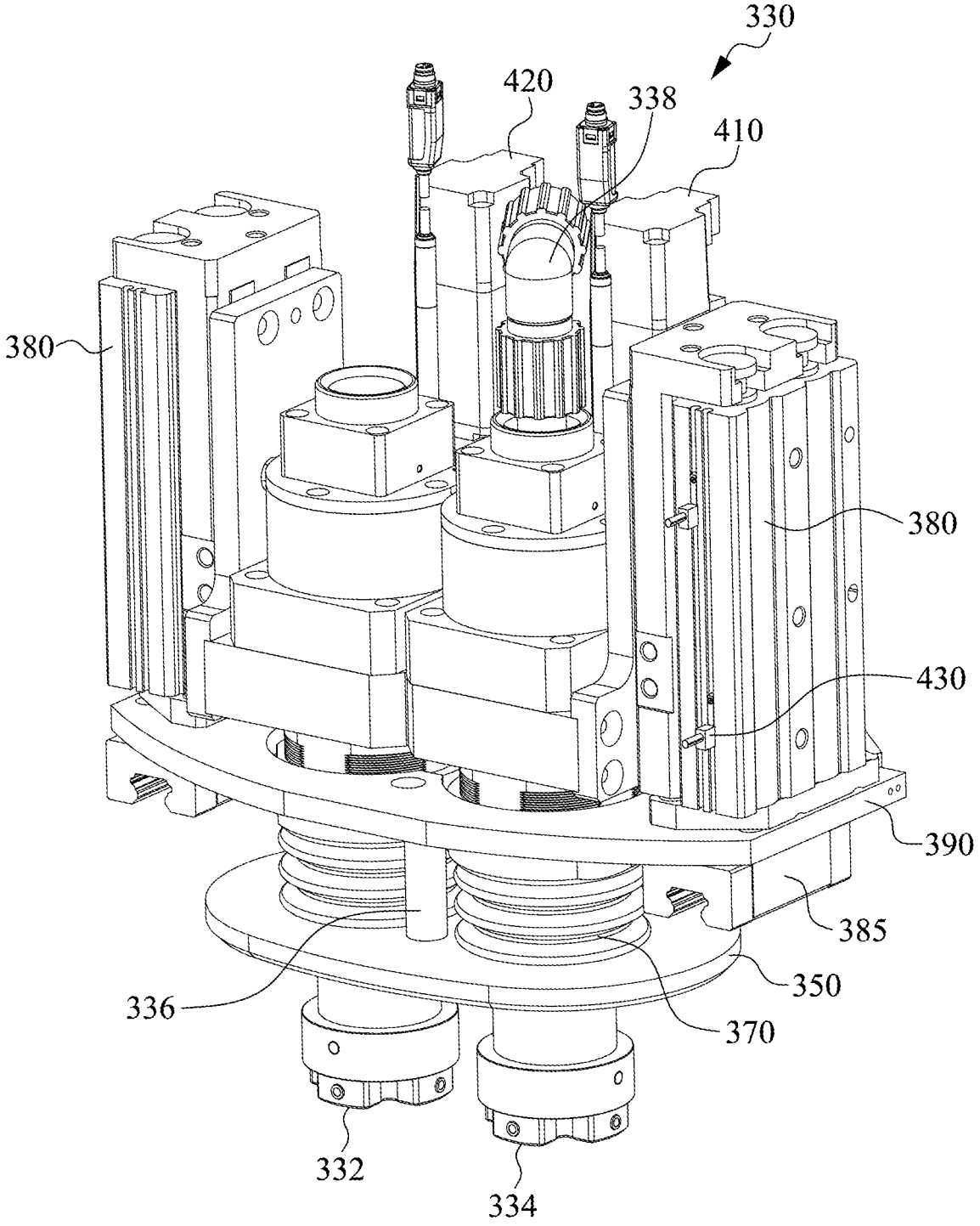
FIG. 4 illustrates a schematic perspective diagram showing a cap rotation device according to embodiments of the present invention.

FIG. 1 illustrates a cap rotation device equipped on a multifunction cap replacement module according to one embodiment of the present invention, FIG. 2 illustrates a cap rotation device equipped on a multifunction cap replacement module according to another embodiment of the present invention, FIG. 3 illustrates a cap rotation device equipped on a cap rotation module according to embodiments of the present invention, and FIG. 4 illustrates a cap rotation device according to embodiments of the present invention.

Referring to FIG. 1, the multifunction cap replacement module 100 includes a cap rotation module supporter 130, a cap rotation module 110 and another cap rotation module 120. The cap rotation module 110 and another cap rotation module 120 are mounted under the cap rotation module supporter 130, and the cap rotation module supporter 130 is mounted on the chemical drum storing device 500. The chemical drum storing device 500 includes a supporting frame 510 to store at least one chemical drum, e.g. a chemical drum 520 and a chemical drum 530, and the cap rotation module supporter 130 can be additionally disposed above the supporting frame 510.

Further referring to FIG. 3, the cap rotation module 300 can be the cap rotation module 110 and/or the cap rotation module 120. The cap rotation module 300 includes at least one pair of cap rotation device, for example, a first cap rotation device 320 and a second cap rotation device 330 as illustrated in FIG. 3. The first cap rotation device 320 can open the sealing cap 532 of the chemical drum 530 and extract the chemical liquid form the chemical drum 530. The second cap rotation device 330 can open another sealing cap 534 of the chemical drum 530 to transfer the chemical liquid back to the chemical drum 530. The first cap rotation device 320 and the second cap rotation device 330 have the same or similar structure to conveniently supply the chemical liquid in the semiconductor factory.

In addition, the cap rotation module 300 further includes a base plate 360 and a cap rotation module central post 310 connected to the base plate 360, and the first cap rotation device 320 and the second cap rotation device 330 are movably mounted on the base plate 360.

In some embodiments, the multifunction cap replacement module 100 includes a fixing plate 390, a vertical moving device 380 and a horizontal moving device 385. The vertical moving device 380, e.g. an air cylinder or a hydraulic cylinder, is connected between the fixing plate 390 and the first cap rotation device 320 or the second cap rotation device 330 to move the first cap rotation device 320 or the second cap rotation device 330 up and down, and the horizontal moving device 385 is disposed between the fixing plate 390 and the base plate 360 to horizontally move the first cap rotation device 320 or the second cap rotation device 330.

In some embodiments, the first cap rotation device 320 includes a cap rotator 322, a liquid transferring device 324, an optical detecting device 326 and a liquid transferring pipe 328. The liquid transferring device 324 is, for example, a liquid extractor. The optical detecting device 326 can detect a position of the sealing cap 532 of the chemical drum 530 to guide the cap rotator 322 to align with the sealing cap 532, the cap rotator 322 opens the sealing cap 532, the liquid transferring device 324 is moved to align with the original position of the sealing cap 532 and sealed to the opening, and the liquid transferring device 324 extracts the chemical liquid and transfer the chemical liquid to the semiconductor manufacturing equipment in the semiconductor factory through the liquid transferring pipe 328.

In some embodiments, the second cap rotation device 330 includes a cap rotator 332, a liquid transferring device 334, an optical detecting device 336 and a liquid transferring pipe 338. The liquid transferring device 334 is, for example, a liquid reflux device. The optical detecting device 336 of the second cap rotation device 330 can detect the position of another sealing cap 534 of the chemical drum 530 to guide the cap rotator 332 of the second cap rotation device 330 to align with the another sealing cap 534 of the cap rotator 332, the cap rotator 332 of the second cap rotation device 330 opens the sealing cap 534, and then the liquid transferring device 334 is moved to the original position of the sealing cap 534 and sealed to the opening to transfer the chemical liquid back to the chemical drum 530 with the liquid transferring device 334.

Referring to FIG. 4, as exemplarily illustrated by the second cap rotation device 330, the second cap rotation device 330 includes a first motor 410 and a second motor 420. The first motor 410 is connected to a liquid transferring device 334 and the liquid transferring device 334 is configured to connect to an opening of the chemical drum 530. The second motor 420 is connected to the cap rotator 332 to open or close the sealing cap 532 from the opening of the chemical drum 530.

In some embodiments, the first motor 410 and the second motor 420 include torque motors to precisely control the cap rotator 332 and the liquid transferring device 334 to open or close the sealing cap 532. While closing the sealing cap 532, the torque motor can effectively control the cap rotator 332 to close the sealing cap 532 on the opening of the chemical drum 530 by detecting the torque value that reached a predetermined torque setting.

In some embodiments, the second cap rotation device 330 further includes a liquid transferring pipe 338 connected to the liquid transferring device 334 to directly transfer the chemical liquid through the opening of the chemical drum 530 to prevent the factory contamination due to the chemical liquid leakage.

In some embodiments, the first cap rotation device 320 and the second cap rotation device 330 are the same or similar with each other to extract the chemical liquid and flow back the chemical liquid. In some embodiments, the first cap rotation device 320 and the second cap rotation device 330 can use different components to extract the chemical liquid and flow back the chemical liquid, without departing from the spirit and scope of the present invention.

In some embodiments, the cap rotator 322 and the liquid transferring device 324 respectively include independent vertical moving devices 380 to independently control the cap rotator 322 and the liquid transferring device 324 to move up and down. In addition, the cap rotator 332 and the liquid transferring device 334 also include independent vertical moving devices 380 to independently control the cap rotator 332 and the liquid transferring device 334 to move up and down.

Simultaneously referring to FIG. 4, as exemplarily illustrated by the second cap rotation device 330, the vertical moving device 380 includes an air cylinder and a position detecting device 430. The position detecting device 430 can detect a current working position of the air cylinder to precisely determine whether the sealing cap 532 is properly opened/closed from the opening of the chemical drum 530.

In some embodiments, the multifunction cap replacement module 100 further includes an isolating plate 350 and an elastic isolating shield 370. The isolating plate 350 includes two openings that allow the cap rotator 322 and the liquid transferring device 324, or the cap rotator 332 and the liquid transferring device 334 to pass through. The elastic isolating shield 370 connects to the isolating plate 350 and the base plate 360 to prevent the evaporated chemical gas of the chemical drum 530 from directly contacting, polluting and corroding the interior components of the cap rotation module 300. The isolating plate 350 of the first cap rotation device 320 has the same shape with the isolating plate 350 of the second cap rotation device 330. In order to illustrate the interior components, the isolating plate 350 of the first cap rotation device 320 is omitted in FIG. 3.

In some embodiments, simultaneously referring to FIG. 1, the multifunction cap replacement module 100 utilizes the base plate 360, the isolating plate 350 and the elastic isolating shield 370 to effectively isolate the evaporated chemical gas from the interior components of the cap rotation module 110 and the cap rotation module 120 of the multifunction cap replacement module 100 to improve the safety and reliability of the multifunction cap replacement module 100 in use. In addition, the cap rotation module 110 further includes sealing walls 112 connected to the base plate 360 to prevent the evaporated chemical gas from contacting the interior components of the cap rotation module 110 and the cap rotation module 120 of the multifunction cap replacement module 100 to further improve the safety and reliability of the multifunction cap replacement module 100 in use. In order to illustrate the interior components, the sealing wall of the cap rotation module 120 is omitted in FIG. 1.

In some embodiments, the cap rotation module central post 310 includes a ventilating channel 340 therein, and the ventilating channel 340 includes a suction port 342 formed on the base plate 360 and an exhaust port 346 connected to an external ventilating machine to exhaust the evaporated chemical gas of the chemical drum 520 and the chemical drum 530 and prevent contamination and corrosion of the cap rotation module 300, thereby further increasing the service life of the multifunction cap replacement module 100.

In some embodiments, the cap rotation module central post 310 can be rotated to position the first cap rotation device 320 and the second cap rotation device 330 to open the cap, extract and flow back the chemical liquid.

Referring to FIG. 2, the multifunction cap replacement module 200 includes a cap rotation module 210 and a horizontal moving module mounted in the cap rotation module supporter 230. The horizontal moving module can move the cap rotation module 210 around a plurality of chemical drums, e.g. the chemical drum 520 and the chemical drum 530, and align the cap rotation module 210 with one of the chemical drums to extract and flow back a desired chemical liquid. In FIG. 1, the multifunction cap replacement module 100 utilizes a plurality of cap rotation modules to respectively connect to a plurality of chemical drums to extract and flow back desired chemical liquids respectively. In FIG. 2, the multifunction cap replacement module 200 utilizes single cap rotation module to selectively connect one of a plurality of the chemical drums and extract and flow back a desired chemical liquid.

In some embodiments, the front ends of the cap rotator 332 and the liquid transferring device 334 include cap opening connectors. The cap rotator 332 and the liquid transferring device 334 respectively adopt corresponding cap opening connectors to engage with the sealing caps 532 of the chemical drum 530 according to types of the sealing caps of the chemical drum, without departing from the spirit and scope of the present invention.

Accordingly, the cap rotation device can utilize the optical detecting device to precisely align with the chemical drum, the cap rotator to open or close the sealing cap from the chemical drum, and the liquid transferring device to connect the opening of the chemical drum after the sealing cap is opened from the opening of the chemical drum. The cap rotation device can further utilize the liquid transferring pipe to directly extract the chemical liquid from the chemical drum so that the connections of the cap rotation device can be effectively reduced, and therefore the contamination and the leakage of the chemical liquid can be effectively reduced. In addition, the cap rotation device can utilize the torque motor and the position detecting device to ensure the safety and accuracy while opening or closing the sealing cap.

As is understood by a person skilled in the art, the foregoing preferred embodiments of the present invention are illustrative of the present invention rather than limiting of the present invention. It is intended that various modifications and similar arrangements be included within the spirit and scope of the appended claims, the scope of which should be accorded the broadest interpretation so as to encompass all such modifications and similar structures.

What is claimed is:

1. A cap rotation device, comprising:

a cap rotator;

a liquid transferring device disposed near the cap rotator;

an optical detecting device disposed between the cap rotator and the liquid transferring device, wherein the optical detecting device detects a position of a sealing cap of a chemical drum to guide the cap rotator aligning with the sealing cap, the cap rotator opens the sealing cap and the liquid transferring device transfers a chemical liquid;

a fixing plate;

two vertical moving devices respectively connected between the fixing plate and the cap rotator, and the fixing plate and the liquid transferring device to vertically move the cap rotator and the liquid transferring device respectively; and two horizontal moving devices connected to the fixing plate to horizontally move the fixing plate.

2. The cap rotation device of claim 1, wherein the liquid transferring device comprises a liquid extractor to extract the chemical liquid from the chemical drum.

3. The cap rotation device of claim 1, wherein the liquid transferring device comprises a liquid reflux device to flow the chemical liquid back to the chemical drum.

4. The cap rotation device of claim 1, further comprising:

an isolating plate; and two elastic isolating shields connected to the isolating plate and the fixing plate to isolate an evaporated chemical gas of the chemical drum.

5. The cap rotation device of claim 4, further comprising:

a first motor driving the liquid transferring device to couple the liquid transferring device to an opening of the chemical drum.

6. The cap rotation device of claim 5, further comprising:

a second motor driving the cap rotator to open or close the sealing cap from the opening of the chemical drum with the cap rotator.

7. The cap rotation device of claim 6, wherein the first motor and the second motor comprise torque motors.

8. The cap rotation device of claim 7, further comprising:

a liquid transferring pipe connected to the liquid transferring device to directly transfer the chemical liquid through the opening of the chemical drum.

9. The cap rotation device of claim 8, wherein each of the vertical moving devices comprises an air cylinder and a position detecting device to detect a working position of the air cylinder, and the cap rotator and the liquid transferring device adopt corresponding cap opening connectors to engage with the sealing cap according to a type of the sealing cap of the chemical drum.

* * * * *